US005932011A

United States Patent [19]

Noakes et al.

[11] Patent Number: 5,932,011

[45] Date of Patent: Aug. 3, 1999

[54] ELECTROSTATIC SPRAYING DEVICES WITH HAZARDOUS CONDITION WARNING SYSTEM

[75] Inventors: Timothy James Noakes; Andrew Jefferies, both of Nr Mold; Maurice Joseph Prendergast, Runcorn; Michael Leslie Green, Nannerch, all of United Kingdom

[73] Assignee: The Procter & Gamble Company, Cincinnati, Ohio

[21] Appl. No.: 08/732,431

[22] PCT Filed: Apr. 28, 1995

[86] PCT No.: PCT/GB95/00972

§ 371 Date: Mar. 21, 1997

§ 102(e) Date: Mar. 21, 1997

[87] PCT Pub. No.: WO95/30489

PCT Pub. Date: Nov. 16, 1995

[30] Foreign Application Priority Data

May 9, 1994 [GB] United Kingdom ..... 9409167

[51] Int. Cl.[6] ..... B05B 5/025

[52] U.S. Cl. ..... 118/629; 118/620; 118/621; 118/300; 118/663; 118/668; 118/707; 118/708; 118/712; 239/691; 427/458; 427/475; 427/483

[58] Field of Search ..... 239/691; 118/620, 118/621, 629, 300, 663, 668, 707, 708, 712; 427/8, 457, 458, 475, 483

[56] References Cited

U.S. PATENT DOCUMENTS

| | | | |
|---|---|---|---|
| 3,851,618 | 12/1974 | Bentley | 118/7 |
| 3,894,272 | 7/1975 | Bentley | 317/3 |
| 4,586,657 | 5/1986 | Johnson et al. | 239/691 |
| 4,682,735 | 7/1987 | Mommsen . | |
| 5,138,513 | 8/1992 | Weinstein . | |
| 5,397,605 | 3/1995 | Barbieri | 427/475 |

FOREIGN PATENT DOCUMENTS

| | | | |
|---|---|---|---|
| 44038 | 7/1981 | European Pat. Off. . | |
| 0 044 038 | 1/1982 | European Pat. Off. . | |
| 0 110 524 | 6/1984 | European Pat. Off. . | |
| 135440 | 3/1985 | European Pat. Off. | 239/691 |
| 0 503 766 | 9/1992 | European Pat. Off. . | |
| 4-83547 | 3/1992 | Japan | 118/621 |
| 4-161262 | 6/1992 | Japan | 118/663 |
| 736435 | 6/1986 | U.S.S.R. | 118/629 |
| 2116386 | 9/1983 | United Kingdom | 427/8 |
| 93 03853 | 3/1993 | WIPO . | |

*Primary Examiner*—Peter Chin
*Assistant Examiner*—Michael P. Colaianni
*Attorney, Agent, or Firm*—William Scott Andes

[57] ABSTRACT

The present invention provides an electrostatic spraying device which includes a primary charge return path between the device and the target to be sprayed and circuitry for warning the operator of potentially hazardous spraying conditions. More particularly, the present invention includes circuitry for warning the operator of conditions wherein the primary charge path is inadequate and other conditions in which the return of spray current via the primary charge path is affected.

19 Claims, 3 Drawing Sheets

ELECTROSTATIC SPRAYING DEVICES WITH HAZARDOUS CONDITION WARNING SYSTEM

This invention relates to electrostatic spraying devices.

In spraying certain objects, problems may arise if an imbalance of electrical charge occurs between the object and the device since there is a risk of an electrical discharge which could result in the operator receiving an electrical shock and/or the production of a hazardous situation if flammable solvents are present (eg as part of the formulation being sprayed). The risk can be minimised by ensuring that there is good electrical continuity between the device and the object being sprayed, for instance by making an electrical connection to the object to provide an earth return path between the object and the device.

According to a first aspect of the present invention there is provided an electrostatic spraying device provided with contact means for providing a primary charge return path between the device and an object to be sprayed. and means for testing a circuit established between the device and the object to be sprayed.

The testing means may be constituted by means for determining the resistance or impedance of the circuit so established.

The testing means may be arranged to detect charge return to the device via the primary charge return path; preferably however the testing means is constituted by means for detecting charge return to the device via routes other than the primary path.

According to a second aspect of the present invention there is provided an electrostatic spraying device provided with contact means for providing a primary charge return path between the device and an object to be sprayed. and means for detecting charge return to the device via an operator holding the device.

Preferably the device also includes means for producing an output signal in response to detection of charge returning via routes other than said primary path.

In this way, the existence or otherwise of a secure and effective primary charge return path can be established. If an effective primary charge return path is not established, there will be a tendency for charge to return to the device via other paths. For instance, in the absence of an adequate primary charge return path. as spraying proceeds charge will build up on the object being sprayed and tend to repel further electrically charged spray droplets which, in turn, may deposit on the operator with consequent return of charge to the device via a route other than the primary path.

Detection of charge return via routes other than the primary path allows detection of an inadequate primary path and other conditions in which the return of spray current via the primary charge path is affected. The existence of a defective primary charge return path may be attributable to an inadequate connection being made to the object. Other conditions that may result in charge return via routes other than the primary path include: overspraying in which deposition of charged spray on to objects other than the intended target occurs; and spraying carried out by an operator wearing insulating footwear.

Thus, for example, if the earth return path is defective as a result of an inadequate connection with the object to be sprayed. this can be detected and signalled to the operator during spraying; if appropriate. the defect can then be remedied before spraying continues to the point where a substantial charge imbalance develops.

The contact means for providing the charge return path conveniently includes an electrical conductor in the form of a lead terminating in connector means for connection to a convenient site on the object to be sprayed.

To provide additional security, the conductor lead preferably comprises twin conductors connected between the device and the connector for attachment to the object to be sprayed so that the two conductors form a loop in such a way that. if one conductor is damaged with consequent impairment of the integrity of the primary charge return path, the break in the loop can be detected and a warning produced and/or spraying terminated automatically.

The conductor or conductors of the contact means will typically be sheathed in a highly insulating material.

The contact means may be releasably connectible to the device and the arrangement is preferably such that. if the contact means is not connected either at all or correctly, spraying operation is disabled. For example. the contact means may be provided with a connector by means of which it is connected to the device in use (eg a jack plug or like connector insertable into a complementary socket associated with the device) so the connector completes a circuit, such as a low voltage supply circuit for powering high voltage generating circuitry of the device, and removal of the connector produces an open circuit in the circuit to prevent normal operation of the device.

Alternatively the contact means may be permanently connected to the device.

The connector means conveniently includes a clip-type connector for attachment to the object and it conveniently has one or more teeth for firmly "biting" into the object to ensure good electrical contact. The jaw design of the clip is preferably such that a high contact force is applied over a small contact area (preferably point contact teeth) with the jaws configured to allow a wide range of substrate types to be gripped.

Preferably the output signal produced in the event of charge return to the device via paths other than the primary charge is of a visual, audible and/or tactile character. It is envisaged that the output signal will be produced in response to the existence of unsatisfactory spraying conditions. However. we do not exclude the possibility of such conditions being signalled by the absence of an output signal as such. For instance, during normal spraying with a properly established primary charge return path. it would be feasible to signal normal conditions by the presence of a signal (eg a flashing light or an audible sound signal) and abnormal conditions by the absence of a signal (eg disabling of the signal). Such an arrangement though possible is not favoured since normal spraying would be accompanied by energy consumption to maintain the signal and the operator would also be required to notice the absence rather than the sudden presence of the signal.

Instead of, or in addition to, the production of an output signal to warn against spraying in certain circumstances, eg when good electrical continuity with the object has not been established, spraying operation of the device may be suppressed or prevented in response to the detection of charge return via routes other than the primary path.

According to a more specific aspect of the invention there is provided an electrostatic spraying device provided with contact means for establishing a primary charge return path between an object to be sprayed and the device. a secondary charge return path, and means for detecting charge return to the device via the secondary path during spraying operation of the device and for producing an output signal indicative of conditions in which continued spraying is potentially hazardous.

The charge detecting means conveniently comprises an arrangement in which charge is stored until a threshold potential is attained whereupon emission of radiation occurs, the radiation being arranged to fall on a radiation-sensitive switch which operates to produce an output signal. A convenient device for producing the radiation emission on attainment of the threshold voltage is a neon discharge lamp. The switch may be a suitable solid state, light sensitive switch.

A potentially hazardous condition may be determined on the basis of the rate of charge return to the device via the secondary path, ie if the rate of charge return (measured for instance as current flow) attains a predetermined value. the output signal may be produced.

The secondary path is preferably connected to electrical circuitry of the device designed to generate high voltage for charging of liquid to be discharged from the device.

Conveniently the output signal is produced constantly or at intervals while such potentially hazardous conditions prevail. For instance. the frequency and/or intensity of the output signal may vary in dependence on the rate of charge return to the device. Thus, as the rate of return increases. the frequency or intensity of the output signal may likewise increase.

Preferably the secondary path includes a terminal portion provided on the housing of the device at a location where it will come into contact with the users hand during use of the device. Thus, for example, the housing of the device may be constructed with a hand grip portion which is provided with, or at least part of which may constitute, the terminal portion. The terminal portion will be made of a material which is sufficiently conductive for the purpose of effecting charge conduction—usually a "semi-conducting" material will suffice. By "semi-conducting" we mean a material having a resistivity within the range about $10^7$ to about $10^{10}$ ohm cm. The terminal portion may also be arranged to provide shock suppression and for this purpose will be present a high resistance, typically about 10 Mohm or greater, eg up to 1 Gohm.

The invention is generally relevant to electrostatic spraying devices of the kind comprising a portable unit suitable for hand-held use and having a nozzle from which liquid to be sprayed is discharged, means for feeding the liquid to the nozzle and circuitry for generating high voltage for application to the liquid. In devices to which the present invention is applicable, the arrangement is usually such that the high voltage generated is applied to the liquid emerging at the nozzle whereby an electric field is established which is effective to draw the liquid into one or more ligaments of smaller diameter than the nozzle outlet. disruption of each ligament leading to the production of a spray of electrically charged droplets.

In one embodiment of the invention an electrostatic spraying device comprises a housing having a hand grip portion. a nozzle. means for containing liquid to be sprayed and for supplying the liquid to the nozzle, means for producing from a low voltage source a high voltage for application to liquid emerging from the nozzle, an electrically conductive lead for establishing a primary charge return path between the object to De sprayed and the device. the lead terminating in a connector for connection to the object. means associated with the hand grip portion for establishing via the operator a secondary charge return path via which charge can return to the device when the primary path is inadequate to prevent build up of a charge imbalance between the object and the device. and means responsive to charge return via the secondary path for producing an output signal indicative of conditions in which continued spraying is potentially hazardous.

The invention finds specific application to devices of the kind disclosed in International Patent Application No. GB94/02407. the entire contents of which are incorporated herein by virtue of this reference.

Thus, according to a further aspect of the present invention there is provided an electrostatic spraying device particularly but not exclusively for use in spraying liquids having resistivities of the order of $5\times10^6$ ohm.cm and viscosities of the order of 1 Poise at a spraying rate up to at least 4 cc/min. said device comprising nozzle means having an outlet, means for feeding liquid to be sprayed to said nozzle means. a high voltage generator. means coupled to the high voltage generator for applying a potential to the liquid emerging at the outlet of the nozzle means. an electrode located adjacent the nozzle means to modify the field intensity in the vicinity of the outlet of the nozzle means. means for electrically connecting the electrode to said high voltage generator to develop on the electrode a potential of the same polarity as the liquid emerging from the nozzle outlet and of a magnitude such that the potential gradient is reduced in the immediate vicinity of the outlet of the nozzle means; first means for establishing a primary charge return path from an object to be sprayed to the device; second means for establishing a secondary charge return path; and means for detecting charge returned via the secondary path.

Usually the electrode comprises a semi-insulating material. By "semi-insulating material" we mean a material which would be regarded as being insulating rather than conductive, eg with a resistivity of at least $1\times10^7$ ohm.cm. but is sufficiently conductive to allow the full operating potential on the forward extremity of the shroud to build up within a time interval such as to ensure that the full operating potential is established on the forward extremity of the shroud before sufficient liquid has collected at the outlet of the nozzle to support ligamentary spraying thereby avoiding any tendency for the spurious spraying, eg spitting, of the liquid to occur which is particularly undesirable for paint spraying applications. Also, the fact that the electrode is composed of a semi-insulating material reduces the risk of corona discharges occurring from imperfections or the like on the electrode. Materials having a bulk resistivity of the order of $10^{11}$ to $10^{12}$ ohm.cm are particularly suitable for use as semi-insulating materials in this aspect of the invention.

The resistivity of the liquid is typically within the range $5\times10^5$ to $5\times10^7$ ohm cm, more usually $2\times10^6$ to $1\times10^7$ ohm cm.

The potential applied to the liquid emerging at the outlet of the nozzle means will normally be in excess of 25 kV, typically up to 40 kV and preferably 28 to 35 kV.

Preferably the potential applied to the electrode is of substantially the same magnitude as that applied to the liquid emerging from the outlet of the nozzle means. In practice, this can be achieved by electrically connecting the electrode and the liquid to a common high voltage output of the voltage generator.

The voltage applied to the liquid may be supplied by means of a connection adjacent the outlet of the nozzle means or it may be supplied via a connection with a cartridge containing the liquid so that the liquid itself is instrumental in conducting the applied voltage to the nozzle outlet. Where the cartridge comprises a conductive component or components, such as a metal casing or a metal valve, the voltage may be applied to the liquid through the agency of such conductive component.

In one convenient embodiment in which the cartridge comprises a metal casing, the voltage applied to both the liquid and to the electrode is supplied from the generator through the agency of the metal casing.

Particularly where the electrode is fabricated from a semi-insulating material, preferably the nozzle means is fabricated from a material which is more insulating than the material forming the electrode and the nozzle means is typically of tapering configuration converging towards the nozzle outlet.

The outlet may be in the form of a generally circular aperture from which the liquid is projected as a single ligament and the electrode is conveniently of annular configuration such as a shroud or collar of said semi-insulating material.

Preferably the device is suitable for hand-held use and the means for feeding the liquid to the outlet of the nozzle means conveniently comprises a user-operable actuator which may be arranged so that the feed rate is governed by the effort applied to the actuator.

Advantageously, the arrangement is such that operation of the actuator of the feed means also effects activation of the voltage generator, preferably in such a way that the voltage is applied to the liquid prior to any liquid being projected away from the outlet means of the nozzle means, thereby avoiding any risk of uncontrolled discharge of liquid from the device and also ensuring that the requisite operating voltage can be established on the electrode prior to commencement of spraying.

For viscous liquids, especially paint formulations suitable for spraying car body panels, the outlet of the nozzle means is desirably at least 500 micron (more preferably at least 600 micron) in diameter in order to achieve the desired spraying/flow rates without requiring undue effort on the part of the user and also to reduce any tendency for blockage by particles suspended in the liquid formulation.

The location of the electrode relative to the outlet means has been found to be particularly critical in terms of securing the production of a divergent spray of droplets having a narrow size distribution. The location will in general depend on the magnitude of the voltage established on the electrode.

In a preferred embodiment of the invention employing a single ligament-producing nozzle means encircled by an annular electrode supplied with a voltage of substantially the same magnitude as the liquid. the electrode is preferably so located that the angle between imaginary lines extending between the forward extremity of the nozzle means and diametrically opposite forward extremities of the annular electrode is in the range 140 to 195°, more preferably between 150 and 180°.

The invention will now be described by way of example only with reference to the accompanying drawings, in which.

Figure 1:
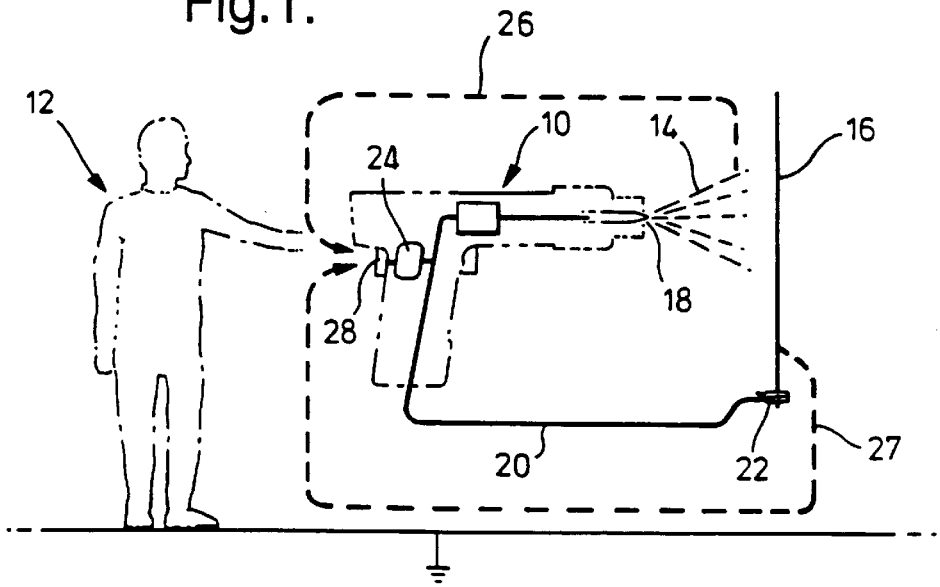
FIG. 1 is a schematic view illustrating the primary and secondary charge return paths associated with operation of a spraying device in accordance with the present invention.

Referring to FIG. 1, a spraying device 10 held by user 12 produces a spray 14 of electrically charged droplets of for instance a paint formulation which, in normal operation, are drawn towards target 16. Inherent in the nature of electrostatic spraying of liquid formulations is the need to form a circuit containing the applicator. the liquid spray cloud emerging from the nozzle 18 of the device 12 and the target substrate. This circuit must be formed to prevent an imbalance of charge between parts of the system and the consequent hazards of static discharge.

In conventional industrial electrostatic spraying systems based on charging of particles by means of a corona discharge, all parts of the system are required to be earth bonded to prevent their becoming elevated in potential when stray charge deposits on them (ie in the form of stray corona and/or charged liquid droplets). The bonding is normally achieved via screw terminals or clamping of the earth return cable to the target substrate and ancillary objects. This is cumbersome for the operator and relevant standards require operator training to identify and make adequate connections. This is obviously not acceptable or feasible for a product intended for a "do-it-yourself" market.

A suitable electrostatic spraying technique for the "do-it-yourself" market is one in which charging of the liquid formulation does not rely on the generation of a corona discharge. Instead high voltage is applied to the liquid emerging at the nozzle of the spraying device (eg via a contact in the vicinity of the nozzle outlet or via the body of liquid) so as to establish an intense electric field relative to the target to be sprayed in such a way that the electrostatic forces assist in drawing the emerging liquid into a ligament which is of a diameter substantially less than that of the nozzle outlet and which thereafter breaks up into electrically charged droplets. This spraying technique involves a very efficient charging process and corona discharges, in normal operation, are virtually non-existent. Also, special earth bonding techniques such as those used in industrial electrostatic spraying techniques are not necessary. It would normally be sufficient to form a charge return circuit (herein referred to as the primary charge return path) between the target substrate and the device. The primary charge return path serves to prevent the development of a charge imbalance between the device and the target.

Normally the target and/or the device is connected to earth, eg indirectly via the user in the case of the device and, in the case of the device. there may be a path to earth via any supporting structure between the target and earth. Thus. for instance, in the case where the target comprises a body panel of a vehicle, the path to earth may be via the vehicle wheels/tyres and more particularly via dirt, grime etc adhering to the wheels. However, the connection to earth is not essential and, in any event, may not be reliably established under all circumstances. More important is that a primary charge return path is established between the device 10 and the target 16 so as to maintain charge balance. In FIG. 1. the primary charge return path is established by means of an electrically conductive lead 20 connected at one end to the device and, at the other end, to the target substrate 16 via a suitable clip 22 which is designed to "bite" into the target substrate, eg a crocodile-type clip.

Provided that a satisfactory electrical connection is made between the clip 22 and the target substrate, satisfactory spraying is usually obtained. However, in certain circumstances problems may arise. Typical situations may include:

- the case where an existing paint film on the target substrate is not broken by the clip;
- the case where the operator clips onto the wrong substrate or an isolated part of the substrate;
- where overspray occurs resulting in some of the spray depositing on to an unintended object; or
- where the operator is isolated from the target for example as a result of wearing highly insulating footwear.

Such problems can be avoided by the provision of a detector 24 for detecting charge return to the device via paths other than the primary path 20. For instance in the case of an inadequate connection being made with the substrate, if spraying continues. the build up of charge on the substrate 16 will result in a tendency for further charge to be repelled. Such charge will consequently seek targets other than the intended target, one such target being the user 12. Thus, an alternative charge return path is via sprayback (initially very small amounts) depositing on the user—this secondary return path is indicated by broken line 26 in FIG. 1 and is in parallel with the primary return path. Another secondary charge return mechanism would be via the ground (broken line 27) and a further mechanism may be charge resulting from stray corona effects which can occur at the nozzle when spraying is affected by the loss of an effective primary charge return path and, in this event. the charge resulting from stray corona may again return to the device via the user 12.

The detector 24 is provided in the secondary charge return path including the user 12 and is connected to the user via a contact pad 28 located on the device in a position for contact with the user's hand, eg the contact pad may be provided on. or form at least part of, a hand grip portion of the device. If the integrity of the primary return path is either not established in the first place or is disturbed during spraying, it will be understood that charge return to the device will increasingly take place via the secondary route or routes. The detector 24 monitors the return of charge via the secondary route(s) and may be arranged to produce a suitable signal. such as a repeated audible bleep (which may increase in amplitude as the level of charge imbalance increases), to warn the user that an inadequate primary charge return circuit has been made. In this way, the user is given the opportunity to remedy the defect and. if unsuccessful. to abandon spraying that particular target because of its unsuitability.

Where problems arise as a result of the operator being isolated from the target, eg as a result of wearing highly insulating footwear. this is due to the operator tending to "float" away from the target potential. As a result. a capacitance is effectively developed between the operator and the target and detectable charge flow will then take place in the secondary charge return path leading to the production of a signal to warn against continued spraying. The problem may then be rectified by a change of footwear.

Establishing a secondary charge return path via the user is a convenient way of detecting charge return to the device via routes other than the primary charge return path afforded by the conductive lead 20. However. in an alternative arrangement, the device may be provided with a charge collection zone (not shown) at a suitable location, eg an exposed surface of the device on to which charge/droplet deposition will tend to occur sprayback or stray corona is produced as a result of a faulty primary charge return path. The detector 24 will then be connected to the charge collection zone so that charge return via this route can be monitored.

Figure 2:
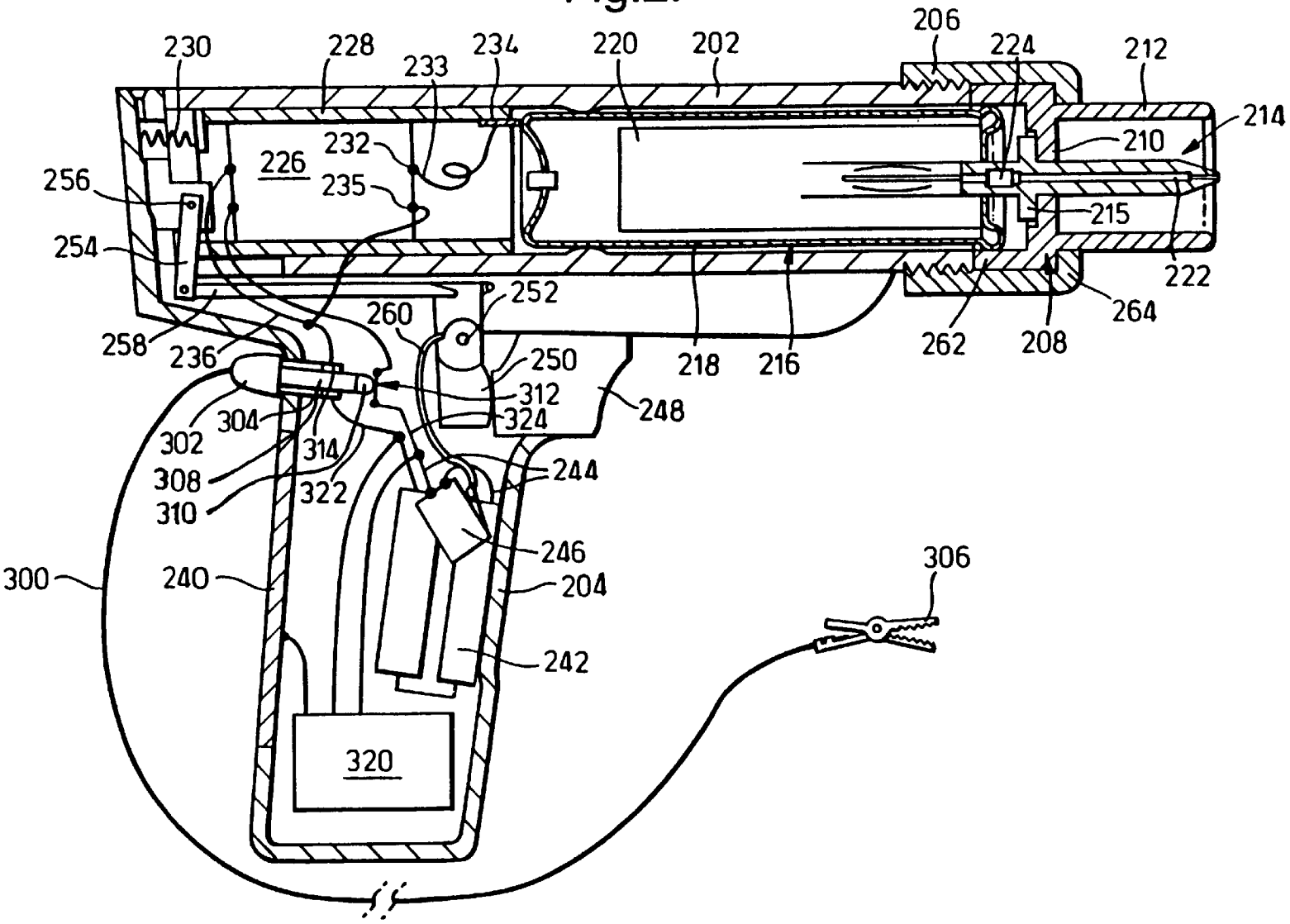
FIG. 2 is a diagrammatic view of a spraying device incorporating circuitry for the detection of charge returning to the device via a route other than the primary charge return path.

Referring now to FIG. 2. application of the invention to a preferred form of spraying device is shown. The spray gun of FIG. 2 is intended for hand-held use and is suitable for use in spraying relatively viscous. low resistivity liquid formulations such as paints, at flow rates of up to at least 4 cc/min. A typical formulation to be sprayed has a viscosity of the order of 1 Poise and a resistivity of the order of $5\times10^6$ ohm.cm. The spray gun comprises a body member 202 and a hand grip 204. The body member 202 is in the form of a tube of insulating plastics material, eg a highly insulating material such as polypropylene. The hand grip 204 may, at least in part, also be of highly insulating material such as polypropylene. At the end remote from the hand grip 204, the body member is provided with a collar 206 which is also composed of a highly insulating material such as polypropylene and which is screwthreadedly or otherwise releasably engaged with the body member 202 for quick release and access to the liquid container. The collar 206 secures a component 208 in position at the end of the body member 202, the component 208 comprising a base 210 and an integral annular shroud 212 which projects forwardly of the gun.

The base 210 has a central aperture through which a nozzle 214 projects, the rear end of the nozzle 214 being formed with flange 215 which seats against the rear face of the base 210. The nozzle 214 is composed of a highly insulating material, such as a polyacetal (eg "Delrin"), typically with a bulk resistivity of the order of $10^{15}$ ohm.cm. The body member 202 receives a replaceable cartridge 216 for delivering liquid to be sprayed to the nozzle 214. As the gun is required to deliver liquid at a flow rate of up to at least 4 cc/min, a positive feed of liquid to the nozzle 214 is needed and in this embodiment of the invention is effected by the use a cartridge in the form of a so-called barrier pack comprising a metal container 218 pressurised by a liquefied propellant. eg fluorocarbon 134A. and the liquid to be sprayed is enclosed within a flexible metal foil sack 220 which separates the liquid from the propellant. The interior of the sack 220 communicates with an axial passage 222 within the nozzle via a valve 224 which operates in a similar manner to the valve of a conventional aerosol-type can in that displacement of the valve in the rearward direction relative to the container 218 opens the valve 224 to permit positive liquid flow into the passage 222 (by virtue of the pressurisation produced by the propellant). The passage 222 terminates at its forward end in a reduced diameter bore forming the outlet of the nozzle. The forward extremity of the nozzle 214 terminates close to or at a plane containing the forward extremity of the shroud 212.

Rearwardly of the cartridge 216. the body member 202 accommodates a high voltage generator 226 which is mounted in a tubular carrier 228. The carrier 228 is mounted for limited sliding movement axially of the body member 202. A tension spring 230 biases the carrier 228 rearwardly. The high voltage generator 226 is of the type which produces a pulsed output and then rectifies and smooths it to provide a high voltage DC output. A suitable form of generator 226 of this type is described in European Patent Application No. 163390. The generator has a high voltage output pole 232 connected by lead 233 to a contact 234 secured to the carrier and arranged for engagement with the rear end of the metal container 218. A second output pole 235 of the generator is arranged to be connected to earth, inter alia via lead 236 and a contact strip 240. In the illustrated embodiment, the contact strip 240 forms part of the hand grip 204 and is composed of a dissipative material. ie one which has some conductivity but provides a resistance (typically of the order of $10^7$ to $10^{10}$ ohm cm) for reasons explained in our prior European Patent Application No. 503766, the disclosure of which is incorporated herein by this reference. A suitable material is Beetle GB8 polyester available from British Industrial Plastics. In this way, when the gun is held by the user, a path to earth can be established through the user. The generator is powered by a low voltage DC supply comprising battery pack 242 accommodated within the handgrip 204 and forming part of a low voltage circuit including lead 236 coupled to earth (via the pad 240 and the user) and a lead 244 connecting the battery pack 242 to the input side of the generator 226 via a microswitch 246.

The valve 224 is opened, in use, by relative movement between the cartridge 216 and the body member 202, the nozzle 214 remaining fixed relative to the body member. Movement to operate the valve 224 is applied to the cartridge 216 by movement of the generator/carrier assembly, the latter being moved by operation of a trigger 248 associated with the handgrip 204 and which, when squeezed, pivots lever 250 about its pivotal connection 252 thereby pivoting a further lever 254 which is pivoted at 256 and is coupled to lever 250 by link 258. The lever 254 bears against the rear end of the carrier 228 so that pivoting of the lever 254 is effective to displace the carrier and hence the cartridge 216 forwardly thereby opening the valve 224. Upon release of the trigger 248. the various components are restored to their starting positions as shown by suitable biassing means including spring 230. Squeezing of the trigger 248 is also accompanied by movement of a linkage 260 which is coupled to the microswitch 246 so that trigger operation is accompanied by microswitch operation to supply low voltage power to the generator 226.

The high voltage produced by the generator. typically in excess of 25 kV for a device designed to spray relatively viscous. low resistivity liquids at flow rates of up to at least 4 cc/min (eg up to 6 cc/min or even more), is coupled to the outlet of the nozzle 214 via contact 234, the metal container 218 and the liquid within the passage 222 to provide an electric field between the nozzle tip and the surroundings at earth potential. This electric field is established with the aim of drawing the liquid emerging at the nozzle outlet into a ligament which will break up into a divergent spray of relatively uniformly-sized. electrically charged droplets suitable for deposition as a uniform film. Because of the relatively viscous nature of the formulation to be sprayed (eg of the order of 1 Poise), the diameter of the outlet has to be made relatively large (typically at least 600 microns) in order to achieve flow rates up to at least 4 cc/min. Also, with relatively viscous materials, to achieve satisfactory ligament formation (especially single, axially directed ligament formation) at flow rates of this order. it is necessary to operate at higher voltages than are necessary for lower viscosity liquids since ligament formation from viscous materials requires increased electric field intensity.

For this reason, the generator 226 employed has an output voltage of 25 kV or greater as measured by connecting the high voltage output of the generator to a Brandenburg 139D high voltage meter having an internal resistance of 30 Gigohm. However, the use of voltages of this order would normally lead to spurious spraying probably as a result of corona discharge effects since the field intensity in the immediate vicinity of the nozzle outlet may exceed the breakdown potential of air. Such spurious spraying may for instance result in highly polydisperse droplets in the form of a mist of very fine droplets splitting off from the ligament and poorly divergent, paraxial streams of coarse droplets.

Satisfactory ligament formation and break up in the presence of voltages of 25 kV or greater is achieved by provision of the component 208 and in particular the annular shroud portion 212. The component 208 is composed of a semi-insulating material (typically with a bulk resistivity up to $10^{11}$–$10^{12}$ ohm.cm), eg "Hytrel" grade 4778 available from DuPont Corporation, and is arranged with a rearwardly projecting annular portion 262 thereof in contact with the metal container 218 so that the voltage applied via the contact 234 is established at the forward extremity of the shroud 212 and is of the same polarity as, and of substantially the same magnitude as, the voltage produced at the outlet of the nozzle 214. The annular portion 262 is trapped between the forward end of the body member 202 and a flange 264 on collar 206 so that component 208 is fixed relative to the body member 202. Operation of the trigger 248 leads to displacement of the container 218 relative to the component 208 but electrical continuity is maintained by sliding contact between the leading end of the container 218 and the inner periphery of the annular portion 262.

It will be understood that contact between the high voltage generator and the shroud may be effected in ways other than the sliding contact arrangement shown; for instance the contact may be made through a spring contact. Usually the contact arrangement will be such as to ensure that a voltage substantially corresponding to that established at the nozzle tip is developed on the shroud in advance of, or substantially simultaneously, with the commencement of spraying so that the shroud is immediately effective on commencement of spraying.

By appropriate location of the forward extremity of the shroud relative to the tip of the nozzle. the field intensity in the immediate vicinity of the nozzle tip can be attenuated sufficiently to produce formation of a single ligament which breaks up into relatively unifomn-sized droplets. The optimum position of the shroud extremity can be readily established by trial and error, ie by means of a prototype version of the gun having an axially adjustable shroud. In this way, the shroud can be adjusted forwardly from a retracted position while observing the nature of the spray. Initially, with the shroud retracted, the spurious spraying effects referred to above are observed and as the shroud is moved forwardly a position is reached where the spray quality improves markedly and relatively uniform-sized droplets are obtained. Adjustment beyond this point does not affect the quality of spraying initially but tends to have a focusing effect. In practice, where the voltage established on the shroud extremity is of substantially the same magnitude as that on the nozzle tip, we have found that the optimum position tends be one in which the tip of the nozzle more or less coincides with a plane containing the forward extremity of the shroud; in a typical arrangement, using a shroud having an internal diameter of 16 mm and an external diameter of 20 mm. the nozzle tip projects about 1 mm beyond this plane. Usually the arrangement will be such that the angle between imaginary lines extending between the forward extremity of the nozzle and diametrically opposite forward extremities of the shroud is in the range 140 to 195°, more preferably 150 to 180° (angles less than 180° corresponding to the nozzle forward extremity being forward of the shroud and angles greater than 180° corresponding to the shroud being forward of the nozzle forward extremity).

The marked difference in the nature of ligament break up can be demonstrated by operating two nozzles under identical conditions with the same liquid, one nozzle being operated without a shroud and the other with a shroud located at an optimum position. A typical break up regime in the case where no shroud is present involves the production of a mist of very fine droplets a short distance from the nozzle outlet followed by break up of the central core of the ligament into streams of poorly divergent coarse droplets. The spray produced in this instance is wholly unsuitable for the production of a uniform film of the liquid (eg paint) on a surface to be sprayed. In contrast, with a shroud located in an optimum position and operating at substantially the same voltage as that prevailing at the nozzle tip, the ligament was observed to travel a substantial distance from the outlet of the nozzle before breaking up into divergent streams of droplets having a narrow size distribution. The production of a spray with droplets having a volume median diameter of less than 100 microns was readily achievable when the nozzle was operated with the shroud in an optimum position.

The presence of the metal container 218. coupled with the relatively high voltage applied at the tip of the nozzle (ie usually greater than 25 kV), can lead to a large build up of capacitively stored charge during spraying with the possibility of the user experiencing an unpleasant electric shock if the user attempts to access the interior of the device on cessation of spraying, eg for the purpose of replacing the cartridge. This possibility may be obviated by the incorporation of means for discharging the capacitively stored charge in response to cessation of spraying, such means being disclosed in published International Application No. WO-A-94/13063.

The spray gun illustrated in FIG. 2 is particularly suitable for spraying liquids having viscosities between 0.5 and 10 Poise (especially 1 to 8 Poise) and resistivities between $5\times10^5$ and $5\times10^7$ ohm.cm (especially between $2\times10^6$ and $1\times10^7$ ohm.cm) at spraying/flow rates of up to at least 4 cc/min and more preferably up to 6 cc/min. The diameter of the nozzle outlet and the voltage output of the voltage generator 226 are selected according to the viscosity and resistivity of the liquid to be sprayed. Typically the nozzle outlet will have a diameter of at least 500 microns, more usually at least 600 microns. in order to avoid blockage by any particles suspended in the relatively viscous liquid (eg. as in the case of a paint formulation) and to achieve the desired spraying/flow rates with the pressure available from the propellant used in the container 218. The DC output voltage of the generator 226 will typically be between 25 and 40 kV, more usually between 28 and 35 kV, as measured by a Brandenburg 139D high voltage meter having an internal resistance of 30 Gigohm. Although it is simpler to connect the shroud 212 to the output of the generator 226 so that the voltage established on the shroud is of substantially the same magnitude as that prevailing at the tip of the nozzle, we do not exclude the possibility of the shroud voltage being significantly different from that of the nozzle tip; in this event, the difference in voltages can be compensated for by appropriate positioning of the shroud relative to the nozzle tip so as to secure the desired divergent spray of droplets having a narrow size distribution.

The embodiment of FIG. 2 is adapted in accordance with the present invention by the provision of a connector lead 300 terminating at one end in a plug 302 which is insertable into a socket 304 on the device and at the other ena in a crocodile-type clip 306 by means of which a good electrical contact can normally be established with the substrate to be sprayed. The stem 308 of the plug 302 is conductive but terminates in a non-conductive tip 310 which, on insertion into the socket, closes a spring-biased switch 312 connected in lead 244 and thereby controlling supply of power to the generator so that the latter can only be activated by means of trigger 248 when the plug 302 is correctly inserted. The stem 308, when inserted, makes contact with an annular contact 314 thereby completing the primary charge return path provided that a good electrical connection is made with the substrate to be sprayed, via the clip 306. A current detection circuit 320 is connected to leads 322 and 324 associated with the low and high voltage terminals of the battery supply 242 and also to the pad 240. The circuit 320, which is described below in connection with FIG. 3, serves to detect charge flow via the user and pad 240 (the secondary charge return path) in the event of an inadequate connection being made through the clip 306.

Figure 3:
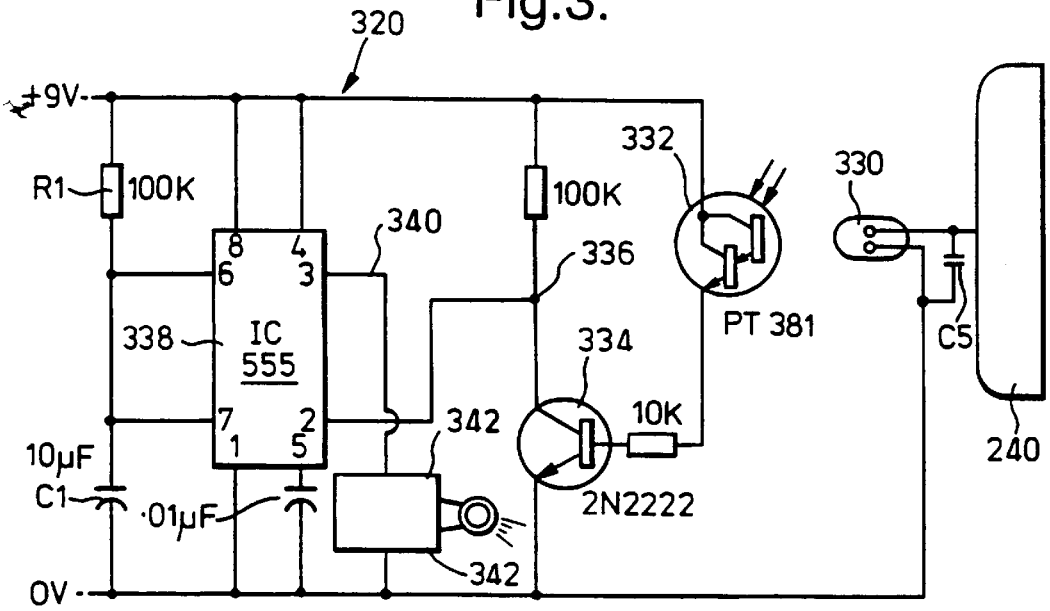
FIG. 3 is a circuit diagram of the detection circuitry in the embodiment of FIG. 2.

Referring now to FIG. 3. the circuit 320 comprises a neon discharge lamp 330 connected between the user contact pad 240 and the low voltage side of the battery supply 242. A capacitor C5 is connected across the terminals of the lamp 330 to control charging and discharging of the lamp. In normal operation of the device. charge return to the device via the user is insignificant. However, if for example the integrity of the primary charge return path is impaired or overspraying on to an unintended target occurs, charge return takes place via the secondary path thereby developing a voltage across the neon lamp 330 which results in a discharge. The light emitted by the discharge is detected by a photosensitive Darlington pair 332 which in turn renders transistor 334 conductive causing a low voltage to be applied, via point 336, to a timer 338 (eg an IC 555 chip). The timer produces an output at 340 with a pulse length determined by of an RC network R1, C1 associated with the timer 338. The output 340 drives a piezoelectric sound generator 342 which serves to produce an audible "bleep". It will be understood that, while the imbalance condition prevails, the bleep will be produced repeatedly until the operator releases the trigger 248 and takes appropriate remedial action, eg ensuring good electrical contact is made between the clip and the substrate to be sprayed. If desired, the circuit arrangement may be such that the bleep produced increases in frequency and/or amplitude as the charge return via pad 240 increases.

Figure 4:
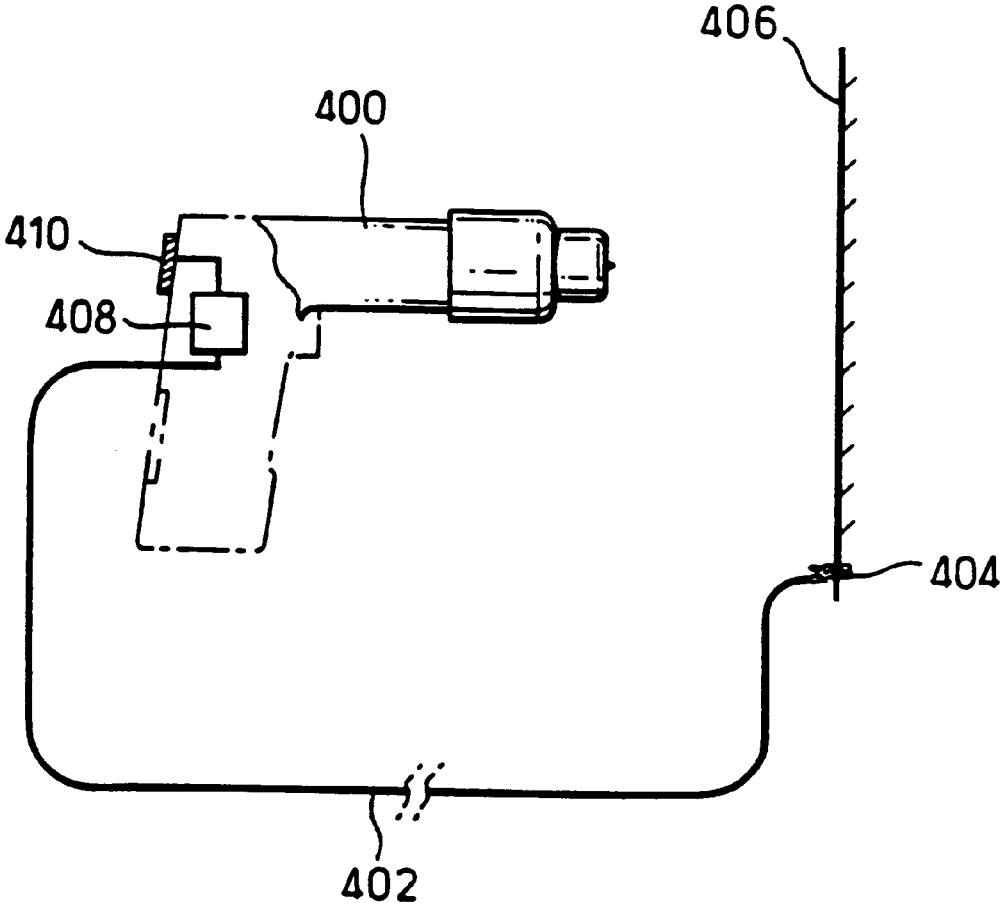
FIG. 4 is a diagrammatic view of an alternative embodiment of the invention.

Referring now to FIG. 4. this illustrates an alternative embodiment of the invention in which the detection of satisfactory spraying conditions is determined by means of an impedance or resistance measuring circuit built into the spraying device. The device 400 may be substantially the same as that described in our prior UK Patent Application No. 9324971.2 and also in relation to FIG. 2 herein and is provided with a lead 402 connected to the device and terminating in a connector 404 which is intended to establish an effective electrical connection to the target 406 to be sprayed. The lead 402 is connected to resistance or impedance measuring circuitry 408 incorporated in the device 400 which in turn has a terminal 410 located externally (but which may be stowed internally when not in use if desired). The terminal 410 is arranged in such a way that it can be readily brought into contact with the target to be sprayed, eg by appropriate manipulation of the device 400, so that a circuit can be completed through through the target between the terminal 410 and the connector 404. When such a circuit has been established, the circuitry 408 can be operated to effect for example a dc resistance measurement and thereby determine whether a satisfactory primary charge return path is present. Operation of the circuitry 408 may be initiated by the user, eg by means of a suitably located test switch associated with the device 400 and arranged to connect the circuitry 408 to the low voltage supply housed within the device 400. The circuitry 408 may be arranged to produce a warning signal. eg visual and/or audible, in the event that the dc resistance measured is in excess of a predetermined threshold. The threshold is selected to provide a suitable safety margin and can be determined empirically.

The terminal 410 is conveniently in the form of a pad or strip of deformable material having some degree of electrical conductivity, a resiliently deformable foam material for example which may be composed of a conductive or semi-conductive material or may be impregnated or filled with conductive or semi-conductive material. eg carbon particles. The terminal 410 is preferably located on the device at a point distant from the nozzle end and, as mentioned previously, will be located so that it can be readily brought into contact with the target. Thus, as shown in FIG. 4, it is located on the rear end of the device 400 and can be pressed against the surface of the target by holding the handgrip the other way round so that the pad 410 is presented forwardly for contact with the target. Once the test has been carried out and a satisfactory result obtained, the device is reversed and spraying can then proceed.

We claim:

1. An electrostatic spraying device of the type designed for handheld use and in which high voltage is applied to the material to be sprayed prior to formation of the spray, said device comprising contact means having a connector for connection to an object to be sprayed to establish a primary charge return path between said device and said object to be sprayed, and means mounted within the device for monitoring charge return to the device via routes other than the primary path, said monitoring means being arranged to produce an output signal in the event that charge return is indicative of an inadequate connection to the target.

2. An electrostatic spraying device comprising contact means for providing a primary charge return path between the device and an object to be sprayed, and means for detecting charge return to the device via a secondary charge return path through an operator holding the device.

3. A device as claimed in claim 2 including means for producing an output signal in response to detection of charge returning via routes other than said primary path.

4. A device as claimed in claim 2 in which the contact means for providing the primary charge return path includes an electrical conductor in the form of a lead terminating in connector means for connection to a convenient site on the object to be sprayed.

5. A device as claimed in claim 4 in which the arrangement is such that, if the contact means is not connected to the device either at all or correctly, spraying operation is disabled.

6. A device as claimed in claim 4 in which the contact means is permanently connected to the device.

7. A device as claimed in claim 3 in which the output signal produced is of a visual, audible, or tactile character.

8. A device as claimed in claim 2 in which means is provided for suppressing spraying operation of the device in the event that charge return via said secondary charge return path is detected.

9. An electrostatic spraying device comprising contact means for establishing a primary charge return path between an object to be sprayed and the device, a secondary charge return path, and means for detecting charge return to the device via the secondary path during spraying operation of the device and for producing an output signal indicative of conditions in which continued spraying is potentially hazardous.

10. An electrostatic spraying device comprising contact means for establishing a primary charge return path between an object to be sprayed and the device, a secondary charge return path, and means for detecting charge return to the device via the secondary path during spraying operation of the device and for producing an output signal indicative of conditions in which continued spraying is potentially hazardous, said charge detecting means comprising an arrangement in which charge is stored until a threshold potential is attained whereupon emission of radiation occurs, the radiation being arranged to fall on a radiation-sensitive switch which operates to produce an output signal.

11. A device as claimed in claim 10 in which the secondary path includes a terminal portion provided on the housing of the device at a location where it will come into contact with the user's hand during use of the device.

12. A device as claimed in claim 11 in which the terminal portion is made of a semi-conducting material.

13. A device as claimed in claim 2 in the form of comprising a portable unit suitable for hand-held use and having a nozzle from which liquid to be sprayed is discharged, means for feeding the liquid to the nozzle and circuitry for generating high voltage for application to the liquid.

14. A device as claimed in claim 2 embodied in a portable unit suitable for hand-held use and having a nozzle from which liquid to be sprayed is discharged, means for feeding the liquid to the nozzle, circuitry for generating high voltage for application to the liquid, and an electrode located adjacent the nozzle to modify the field intensity in the vicinity of the outlet of the nozzle, means for electrically connecting the electrode to said high voltage generator to develop on the electrode a potential of the same polarity as the liquid emerging from the nozzle outlet and of a magnitude such that the potential gradient is reduced in the immediate vicinity of the outlet of the nozzle means.

15. An electrostatic spraying device comprising a housing having a hand grip portion, a nozzle, means for containing liquid to be sprayed and for supplying the liquid to the nozzle, means for producing from a low voltage source a high voltage for application to liquid emerging from the nozzle, an electrically conductive lead for establishing a primary charge return path between the object to be sprayed and the device, the lead terminating in a connector for connection to the object, means associated with the hand grip portion for establishing a secondary charge return path via which charge can return to the device through an operator when the primary path is inadequate to prevent build up of a charge imbalance between the object and the device, and means responsive to charge return via the secondary path for producing an output signal indicative of conditions in which continued spraying is potentially hazardous.

16. A device as claimed in claim 15. suitable for use in spraying liquids having resistivities of the order of $5\times10^6$ ohm.cm and viscosities of the order of 1 Poise at a spraying rate up to at least 4 cc/min. said device comprising said nozzle having an outlet. means for feeding liquid to be sprayed to said nozzle. a high voltage generator. means coupled to the high voltage generator for applying a potential to the liquid emerging at the outlet of the nozzle, an electrode located adjacent the nozzle to modify the field intensity in the vicinity of the outlet of the nozzle, means for electrically connecting the electrode to said high voltage generator to develop on the electrode a potential of the same polarity as the liquid emerging from the nozzle outlet and of a magnitude such that the potential gradient is reduced in the immediate vicinity of the outlet of the nozzle; first means for establishing a primary charge return path from an object to be sprayed to the device; second means for establishing a secondary charge return path; and means for detecting charge returned via the secondary path.

17. A device as claimed in claim 16 in which the electrode comprises a semi-insulating material.

18. A device as claimed in claim 1 in which the means for monitoring charge return to the device is constituted by means for determining the resistance or impedance of the circuit so established.

19. A method of electrostatically spraying a flowable material onto a target by means of an electrostatic spraying device, comprising establishing a primary charge return path between the target and the device, monitoring charge return to the device via a route or routes other than the primary charge return path during spraying and producing an output signal in the event that charge return via such other routes occurs or is in an amount exceeding a predetermined value and is indicative of an inadequate primary charge return path.

* * * * *